US005921289A

United States Patent [19]

Johnson

[11] Patent Number: 5,921,289

[45] Date of Patent: Jul. 13, 1999

[54] METHOD AND APPARATUS FOR TYING AND BINDING BALES OF COMPRESSED MATERIALS

[75] Inventor: Gerald L. Johnson, Carthage, Mo.

[73] Assignee: L&P Property Management Company, South Gate, Calif.

[21] Appl. No.: 08/872,599

[22] Filed: Jun. 10, 1997

[51] Int. Cl.[6] ..... B21F 15/04

[52] U.S. Cl. ..... 140/93.6; 140/115

[58] Field of Search ..... 140/39, 93.6, 115, 140/118, 119, 120, 122, 149

[56] References Cited

U.S. PATENT DOCUMENTS

| | | | |
|---|---|---|---|
| 218,741 | 8/1879 | Higgins . | |
| 275,366 | 4/1883 | Dederick . | |
| 985,023 | 2/1911 | Fry . | |
| 989,260 | 4/1911 | Hinckley . | |
| 1,180,934 | 4/1916 | Mottier . | |
| 1,404,260 | 1/1922 | Arnold | 403/324 |
| 1,581,794 | 4/1926 | DeHaven, Jr. . | |
| 1,699,482 | 1/1929 | Stevens . | |
| 1,706,116 | 3/1929 | Harrah . | |
| 1,889,372 | 11/1932 | Nolan . | |
| 2,098,945 | 11/1937 | Davis . | |
| 2,173,403 | 9/1939 | Trimble . | |
| 2,757,599 | 8/1956 | Nolt et al. . | |
| 2,777,384 | 1/1957 | Nolt et al. . | |
| 2,792,776 | 5/1957 | Tarbox . | |
| 2,796,662 | 6/1957 | Saum . | |
| 2,859,687 | 11/1958 | Hill . | |
| 2,922,359 | 1/1960 | Brouse et al. . | |
| 2,982,199 | 5/1961 | Jones . | |
| 3,918,358 | 11/1975 | Burford . | |
| 3,968,761 | 7/1976 | Tarrants . | |
| 4,120,238 | 10/1978 | Schafer . | |
| 4,155,296 | 5/1979 | Schafer . | |
| 4,167,902 | 9/1979 | Bister et al. . | |
| 4,178,845 | 12/1979 | DeGryse . | |
| 4,459,904 | 7/1984 | Probst et al. . | |
| 4,572,554 | 2/1986 | Janssen et al. . | |
| 5,279,336 | 1/1994 | Kusakari et al. . | |

FOREIGN PATENT DOCUMENTS

| | | |
|---|---|---|
| 152933 | 8/1953 | Australia . |

*Primary Examiner*—Lowell A. Larson
*Attorney, Agent, or Firm*—Wood, Herron & Evans LLP

[57] ABSTRACT

A mechanism for securing together the overlapped ends of an elongated binding device wrapped around a bale of compressible material for binding the bale comprises a housing and a twister pinion rotatably coupled to the housing and configured to receive overlapped ends of the elongated binding device into a slot therein. The twister pinion includes alignment pins positioned on opposite sides of the slot for engaging the overlapped ends and maintaining those ends in the pinion slot. A drive mechanism is coupled to the pinion and rotates the pinion to twist the overlapped ends. In another embodiment of the invention, the twister pinion is coupled to a twister gear by an alignment pin which extends into an alignment aperture and an alignment groove in the gear and pinion. In another embodiment of the invention, a retrieving device is movably coupled with the body for moving toward and away from the twister pinion for moving the ends of the binder device into the twister pinion slot.

21 Claims, 6 Drawing Sheets

METHOD AND APPARATUS FOR TYING AND BINDING BALES OF COMPRESSED MATERIALS

FIELD OF THE INVENTION

The present invention relates to the tying or binding of bales of compressed material, and more specifically, the invention relates to an apparatus and method for tying and securing wires or other binding devices wrapped around bales.

BACKGROUND OF THE INVENTION

Various types of loose materials are shipped, stored, and otherwise processed and distributed in the form of compressed bales. For example, cotton is processed into compressed bales so that a greater amount of cotton may be stored and shipped in a smaller space. Also, bales are generally easier and more efficient to handle than the loose, bulk material.

When the loose material is compressed into bales, it is generally known to wrap and tie such bales with wire or other elongated binding devices to keep the bales in a compressed form, such as for shipping and storage. Wire is often most preferable as a binding device because of its low cost and the ease with which it is handled. One method of forming a bale directs the compressible material into an automatic baler where it is pressed into a bale by a ram and then moved on a path by the ram through the baler. Continuous wire strands extend across the bale path at different heights on the bale and, as the bale moves through the baler, the wire strands are wrapped around the front end and sides of the bale. For such automatic balers, automatic tying systems are often used to engage the bale and wire strands and tie the wire strands around the bale, such as by twisting together the overlapped ends of the wire strands. Examples of various automatic tying methods are illustrated in U.S. Pat. Nos. 4,120,238; 4,155,296; 4,167,902, and 4,459,904.

While automatic tying methods and apparatuses have proven suitable for baling and tying compressed bales in certain applications, they generally require complex, expensive machinery which has to manipulate the wires and bales together to form and tie the bale. Certain applications require hand splicing or tying of the wires wrapped around a bale in order to reduce the complexities and costs associated with automatic tying mechanisms. Furthermore, the particular material being baled may dictate that hand tying is required, because of the complexities involved in trying to design an automatic tying apparatus.

Handtying or splicing mechanisms in the prior art have provided a means for splicing or tying two wires together. However, many such devices suffer from the disadvantages of being bulky and complicated to utilize. Furthermore, they often do not address the unique problems and scenarios which exist when bale wire ends are being tied together around a bale of compressed material. Still further, many such splicers or tying mechanisms are made for wires which have overlapped ends which stay neatly together, whereas the overlapped ends of wires wrapped around compressed bales tend to want to separate before and during twisting. Such prior art tying mechanisms often do not adequately work for all tying situations where the wire ends are not neatly overlapped or held together.

Another drawback in the prior art is the need for a number of different, specially modified twist apparatuses for handling different gauges of wire. This need drives up the cost of the operation when the bale tying applications require different wire sizes.

Therefore, there is a need for a hand-tying mechanism which will rapidly and adequately tie and secure a wire or other similar binding device around a bale of compressed material.

It is another objective of the present invention to provide a simple and inexpensive apparatus for tying a wire around a bale rapidly and easily.

It is an objective to handle and tie wire wrapped around bales while keeping the overlapped ends of the wire together during tying for a proper knot.

It is a further objective of the present invention to wrap and tie bales with a strong durable twist or knot which has sufficient strength to hold the bales together even during handling.

It is still another objective the present invention to provide a simple, less complicated tying apparatus that may be readily utilized for various different baled materials and with various different gauges of baling wire.

These and other objectives will become more readily apparent from the Summary of the Invention and Detailed Description set forth hereinbelow.

SUMMARY OF THE INVENTION

In accordance with the above objectives, and to address the disadvantages in the prior art, one embodiment of the invention comprises a generally yoke-shaped housing with first and second twister gears and respective pinions rotatably coupled to the opposing legs of the yoke-shaped housing. Each of the twister gears and associated pinions has a slot formed therein, and the slots are aligned to receive overlapped ends of the tying wire. Each pinion includes an alignment structure positioned in the slot which is operable for engaging the overlapped ends of the wires and maintaining those ends in the pinion slot in an overlapped orientation for proper twisting.

More specifically, the preferred embodiment of the alignment structure includes a pair of pins which extend into the slot in a direction generally perpendicular to the longitudinal axis of the slot. The pins are positioned on either side of the slot and are staggered longitudinally in the slot. When overlapped wires are positioned in the slot, the wires slide between the pins and are directed therearound to slightly kink the wires for maintaining the overlapped wire ends in the slot and aligned together generally parallel within the twister pinion and gears.

The twister gears are beveled and engage a beveled drive gear which is coupled to a rotatable handle. Each beveled twister gear is positioned on an opposing side of the beveled drive gear so that when the hand crank is turned, the drive gear rotates each of the twister gears in an opposite direction from the other gear for twisting the wire. The alignment pins maintain the overlapped ends in the proper position in the twister pinions for providing a tight and multiple turn twist or knot in only a few turns of the handle. After the overlapped ends have been twisted together to secure the wire, such as around a bale of compressible material, the yoke-shaped housing is moved away from the wires, and the twisted ends slide out of the pinions and gears. The invention further comprises a spring-loaded alignment device which fits into a detent formed in the drive gear when the slots in the two pinions are properly aligned with each other so that the overlapped wire ends may slide easily into or out of the pinions. In a preferred embodiment of the invention; the drive gear to twister gear ratio is 1:2, so that every time the drive gear is rotated for one complete rotation, each of the twister gears makes two complete rotations.

In accordance with another aspect of the present invention, the outer ends of the pinions include spring-loaded locking structures which, in a rest position, extend across a portion of the slot to hold the wires in the pinion slot. When the overlapped wire ends are first engaged by the inventive mechanism, the locking structures move out of the way to open up the locked portion of the slot to thereby allow the wires to pass into the slot. Once the wires are securely in the slot, the locking mechanism is spring biased to again close the portion of the slot to hold the overlapped wires securely in the twister pinions.

In accordance with another aspect of the present invention, each twister pinion has an alignment groove formed therein. The respective twister gear includes an alignment aperture formed to extend through a central bore of the twister gear which receives a portion of the twister pinion. An alignment pin extends into the alignment aperture of the twister gear and engages the alignment groove of the twister pinion to align and couple the gear and pinion together for twisting the overlapped ends. The alignment pin is operable for being rapidly removed to uncouple the gear and pinion so that another pinion of a different dimension may be coupled with the twister gear. In that way, the inventive mechanism may be quickly and easily retrofitted for twisting wires having different gauges. The invention thus eliminates the need for purchasing specially designed mechanisms for each of the different sizes of wires which might be utilized for wrapping a bale of compressed material.

In accordance with another aspect of the present invention, bearing blocks are mounted on the yoke-shaped housing for coupling the inventive mechanism to a track. In that way, the mechanism may be easily and precisely moved across a bale to tie each of the various wires positioned at different lengths along the bale. As such, a single mechanism may be utilized to tie all wires on a bale, further reducing the cost of the operation by eliminating the need for a separate tying mechanism for each wire wrapped around a bale.

Another embodiment of the invention utilizes a moveable retrieving device for engaging the ends of the binding wire and moving the ends into twister gear slots for twisting the ends and tying them together. More specifically, the twisting mechanism has a similar yoke-shaped housing with first and second twister pionions rotatably coupled to the opposing legs of the yoke-shaped housing. Each of the twister pinions has an associated gear coupled thereto and has a slot formed therein. The slots of the opposing pinions are aligned to receive overlapped ends of the tying wires. Each of the twister pinion gears are beveled and engage a central beveled drive gear mounted on the crossbar of the yoke-shaped housing between the twister gears. Similar to the embodiment discussed above, the pinion gears engage the central drive gear on diametrically opposite sides of the central gear. When the drive gear is rotated, each twister gear is driven in a direction which is opposite to the direction of the other opposing twister gear. In that way, the overlapped ends are twisted and tied together. The beveled gear drive is connected to a rotatable handle so that the bevel gear is manually rotatable.

The retrieving device extends generally through the center of the drive gear parallel to the drive shaft and moves forwardly and backwardly with respect to the slotted twister pinions and in a direction perpendicular to the axes thereof. The retrieving device is coupled at one end to a handle for manual manipulation, and includes an angled slot formed in the opposite end for engaging the overlapped ends of the tying wires. In use, a pair of overlapped wire ends are grasped by the angled slot of the retrieving device when it is pushed outwardly beyond the aligned slots of the twister pinions. The retrieving device slot is dimensioned to keep the wires overlapped properly for twisting. The handle on the end of the retrieving device is then pulled inwardly so as to pull the overlapped wire ends into the slots of the twister pinions until the overlapped wires are located proximate the axes of the twister pinions. The retrieving device aligns the overlapped wires with the pinion slots. The hand crank is then turned to rotate the twister gears in opposite directions, thereby twisting the overlapped wire ends into a knotted configuration. After completion of the twist, the handle attached to the retrieving device is pushed outwardly to move the knotted wires out of the twister gear slots and thus eject the wires from the twisting mechanism.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
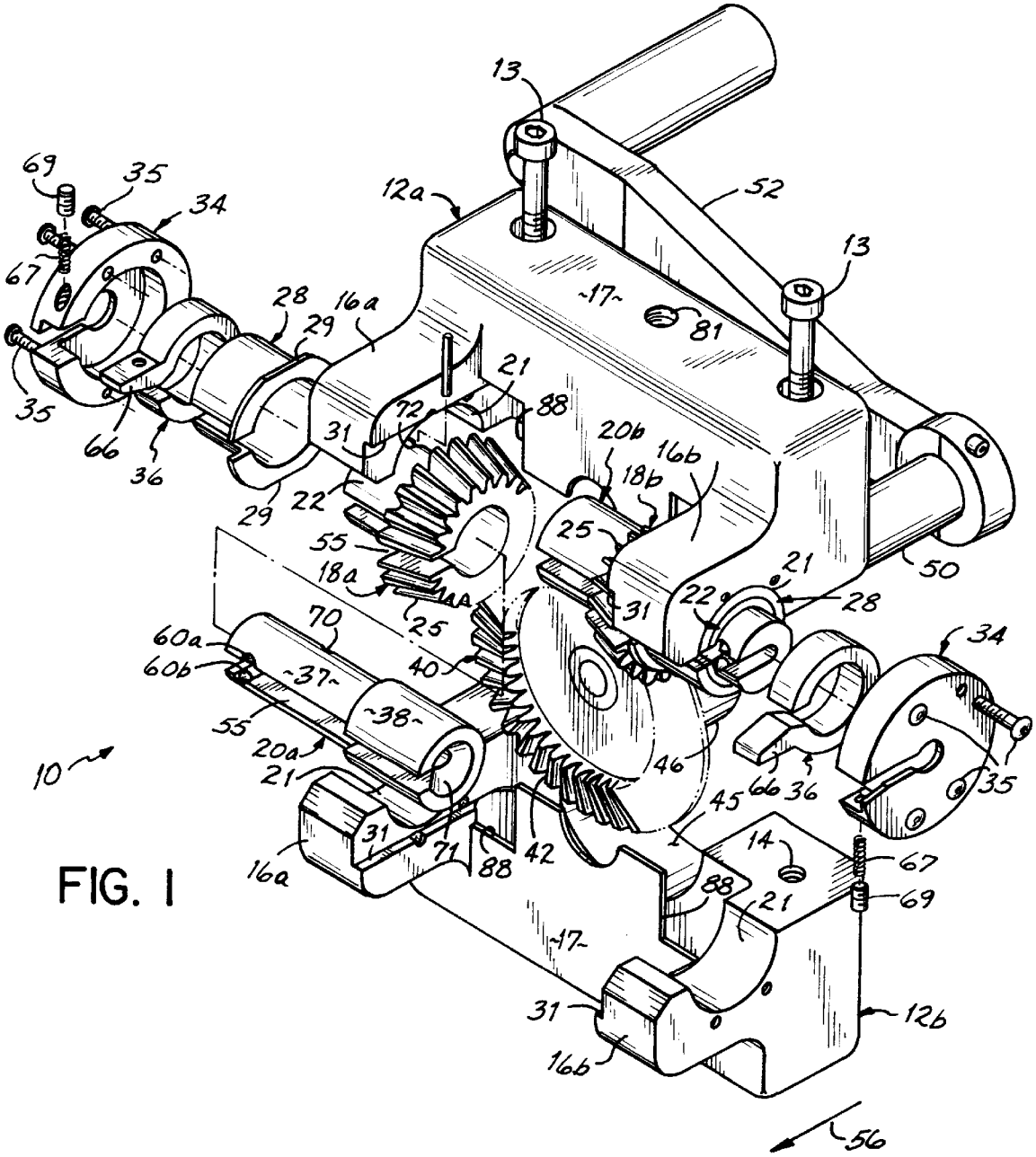
FIG. 1 is a disassembled perspective view of one embodiment of the bale tying apparatus of the invention.

FIG. 1 illustrates a disassembled perspective view of one embodiment of the wire-tying apparatus of the invention where the tying apparatus 10 comprises a yoke-shaped housing 12 separated into two parts 12*a*, 12*b* which are held together by appropriate fasteners such as bolts 13 which are screwed into threaded openings 14. The yoke-shaped housing has two opposing legs 16*a*, 16*b* which project forwardly of a cross bar section 17 (see FIG. 3). Each of the legs 16*a*, 16*b* are appropriately formed for rotatably supporting first and second twister gears 18*a*, 18*b* and respective pinion 20*a*, 20*b*.

Figure 4:
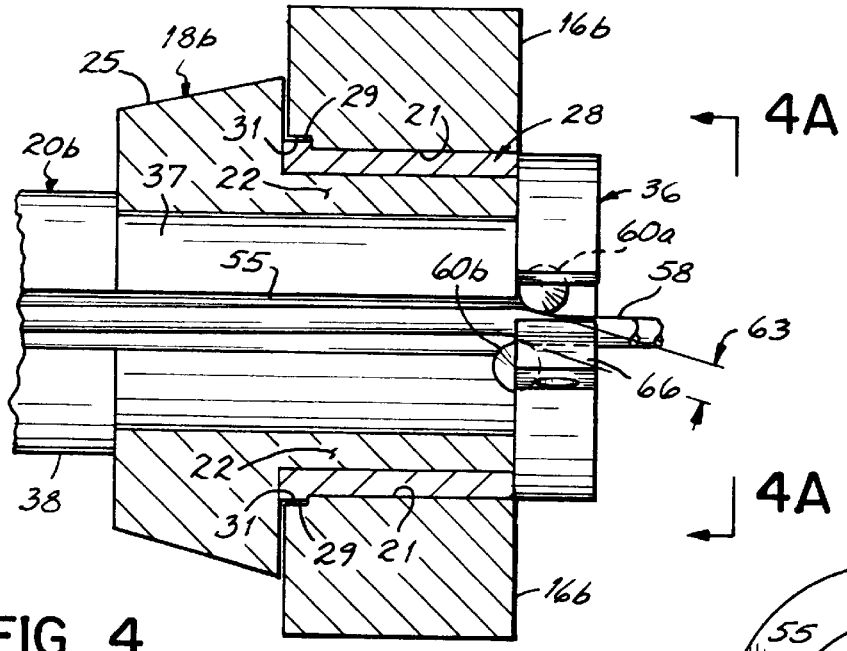
FIG. 4 is a cross-sectional view of a section of a twister pinion with locking structure from the embodiment of the invention illustrated in FIG. 1.

Referring to FIG. 1, housing legs 16*a*, 16*b* form cylindrical openings which receive the pinions 20*a*, 20*b* and a hub portion of 22 of the twister gears 18*a*, 18*b* (see FIG. 4).

As illustrated in FIG. 1, the twister gears 18*a*, 18*b* and the respective twister pinions 20*a*, 20*b* are positioned to oppose each other in housing 12. The twister gears are beveled as shown, and the teeth portion 25 of each twister gear 18*a*, 18*b* faces inwardly of the yoke-shaped housing 12 to be positioned between the respective legs 16*a*, 16*b*. As mentioned above, the hub portion 25 of each twister gear is mounted in the cylindrical opening 21 in the housing legs for rotating therein. Referring to FIG. 4, an appropriate sleeve bearing 28 is positioned in opening 22 to engage hub portion 25 of each twister gear 18*a*, 18*b* for smooth rotation of the twister gear and respective pinion. As illustrated in FIG. 1 , each sleeve bearing 28 has opposing upper and lower flat edges 29 which engage upper and lower edges 31 formed in the housing legs 16*a*, 16*b*. In that way, each sleeve bearing is maintained in a stationary position as the gears and pinions rotate. When the gears, pinions and sleeve bearing are positioned in the legs of the housing 12, the outermost ends of the pinions are covered or capped by covers 34 which are fastened to the legs of housing 12 utilizing appropriate fasteners such as bolts 35. Contained between the covers 34 and housing legs 16*a*, 16*b* are locking structures 36 which operate to hold the overlapped wire ends within mechanism 10 for proper twisting as described further hereinbelow.

For turning the twister gears and twister pinions, and tying overlapped wire ends held therein, mechanism 10 includes a beveled drive gear 40 which is positioned to rotate on the cross bar 17 between the legs 16*a*, 16*b* Drive gear 40 has a beveled tooth portion 42 coupled to a hub portion 44. The hub portion 44 fits into an appropriately formed opening 45 in housing 12 to allow for rotation of the drive gear 40 therein. Between opening 45 and hub portion 44 is positioned an appropriate sleeve bearing 46 for smooth rotation of the drive gear 40. (see FIG. 2).

In a preferred embodiment of the invention, drive gear 40 is manually turned by rotation of a shaft 50 which friction fits into an appropriately formed opening in hub portion 44. Shaft 50 is appropriately coupled to the handle 52 for rotation of the shaft (see FIG. 1). In a preferred embodiment of the invention, drive gear 40 has approximately 40 teeth while each of the twister gears 18*a*, 18*b* have approximately 20 teeth. In that way, one full revolution or rotation of the drive gear 40 will turn each of the twister gears approximately two complete revolutions. That is, the drive gear to twister gear ratio is approximately 2:1.

Turning again to FIGS. 1 and 2, it may be seen that each of the twister gears 18*a*, 18*b* are positioned with respect to the drive gear 40 at diametrically opposed positions of the drive gear. That is, each twister gear 18*a*, 18*b* is positioned 180° around the drive gear 40 from the opposing twister gear. In that way, rotation of the drive gear will drive one of the twister gears in one direction, such as a clockwise direction, while driving the other twister gear in the opposite direction, such as a counter-clockwise direction. As further described herein, overlapped wire ends positioned in the twister pinions will be twisted in opposite directions to form a knotted configuration or knot which holds the overlapped wire ends together and ties a bale.

Figure 2:
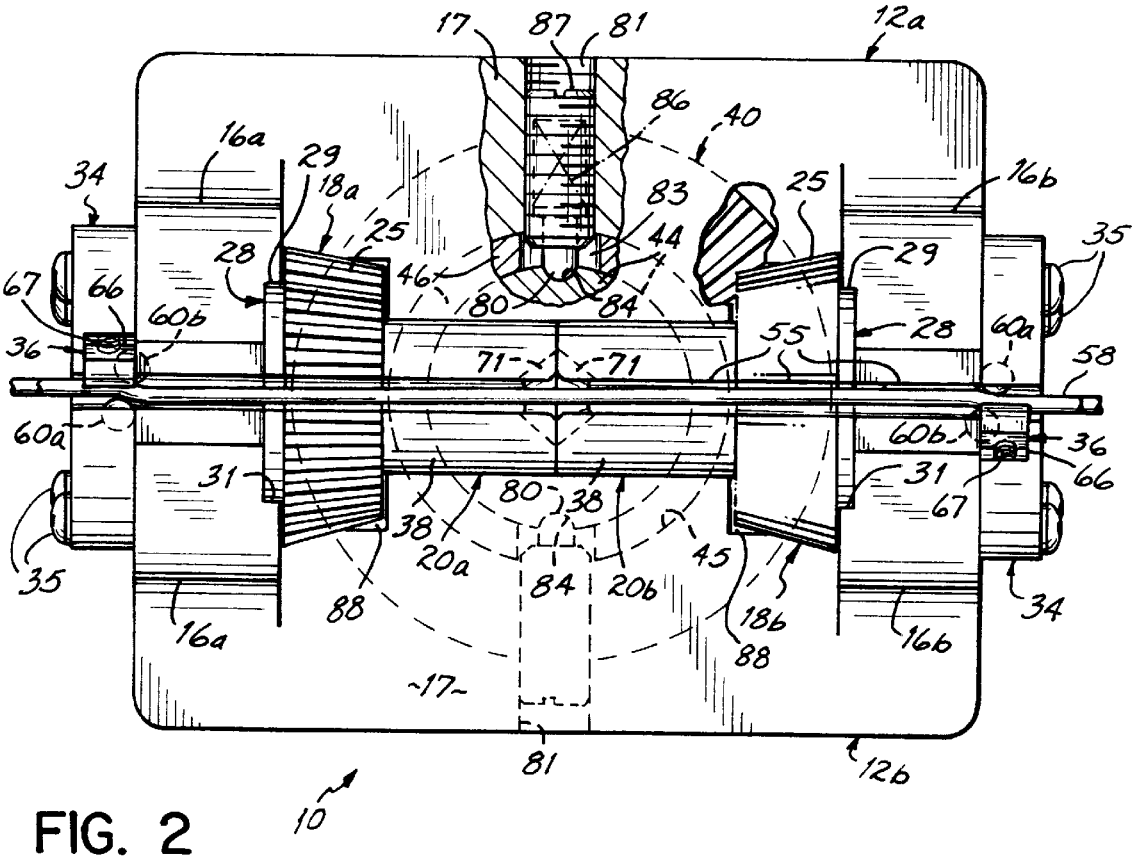
FIG. 2 is a front view of the embodiment of the invention illustrated in FIG. 1.
Figure 5:
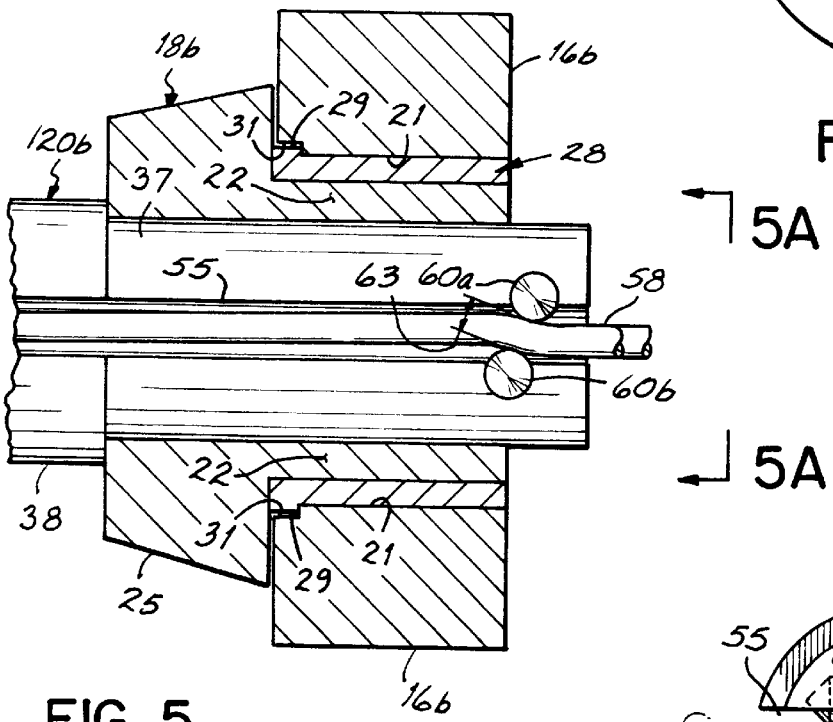
FIG. 5 is a cross-sectional view of a section of a twister pinion from the embodiment of the invention illustrated in FIG. 1.

Turning now to FIGS. 2, 4, and 5. Each of the twister gears, pinions, and associated structures are slotted for receiving overlapped wire ends. Each of the various components (gears, pinions) through which the overlapped wire ends pass has its own slot form therein, and the slots align for passage of the wire ends into mechanism 10 to be twisted and tied. For ease of reference herein, the aligned slots will be collectively referred to as slot 55, where appropriate, and each of the respective individual slots for the various components will be referred to as portions of slot 55, where appropriate.

When a bale of compressible material (not shown) has been compressed with elongated binding devices or wires wrapped therearound, the ends of the wires will be overlapped and must be tied together to securely bind and tie the bale. Mechanism 10 is moved appropriately to engage the overlapped ends, such as in the direction of arrow 56 in FIG. 1. The overlapped ends, collectively designated in FIG. 4 as 58, slide past the housing legs 16*a*, 16*b* and into the respective pinions 20*a*, 20*b*, twister gears 18*a*, 18*b*, bearings 28, locking structures 36, and covers 34. Referring to FIG. 1, the twister pinions 20*a*, 20*b* include a small diameter portion 37 which fits within the hub portion 22 of each twister gear and a larger diameter portion 38 which extends outside of each twister gear. In the assembled mechanism shown in FIG. 2, the larger portions 38 of the twister pinions 20*a*, 20*b* extend between respective twister gears to effectively complete slot 55 of mechanism 10. In accordance with the principles of the present invention, each twister pinion has an alignment structure formed therein which maintains the overlapped wire ends 58 within the pinion portions of the slot 55.

Figure 4A:
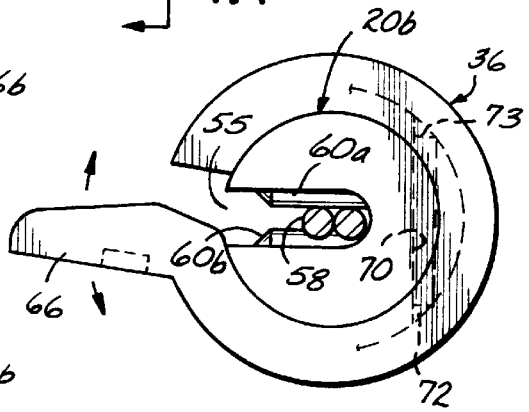
FIG. 4A is a side view of FIG. 4 taken along lines 4A—4A.

Referring to FIG. 4, one embodiment of the alignment structure comprises opposing pins extending into the slot in a direction generally perpendicular to the slot and perpendicular to the axis of the pinion. In that way, the alignment pins 60*a*, 60*b* will engage the overlapped wire ends 58 in the slot 55. The vertical distance between the pins indicated by reference numeral 62 in FIG. 4A is preferably less than the diameter of the wires to be tied. In accordance with the principles of the present invention, one of the pins, such as pin 60*a* is staggered longitudinally in the slot from the other pin 60*b* so as to provide a diagonal dimension, indicated by reference numeral 63 in FIG. 4, which is wide enough to accommodate the diameter of the wires to be tied. In that way, the staggered pins 60*a*, 60*b* frictionally engage the overlapped wire ends 58 and introduce a kink therein for securing the overlapped wire ends 58 in the slot 55. That is, the wires 58 will not fit directly through the pins, but must kink slightly up or down to travel diagonally through the pins. In a preferred embodiment, pin 60*a* is staggered longitudinally from pin 60*b* a suitable distance which provides a diagonal dimension 63 the same as, or very close to, the diameter of the wires to be tied. In that way, the pins will also frictionally engage the overlapped ends 58 and contain them therein within the slot.

Figure 5A:
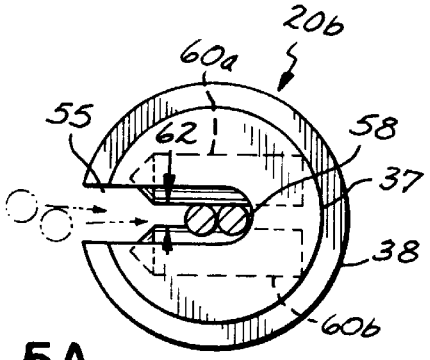
FIG. 5A is a side view of FIG. 5 taken along lines 5A—5A.

Referring to FIGS. 5 and 5A, the diagonal spacing 63 and vertical spacing 62 between the pins 60*a*, 60*b* are chosen so that the overlapped wire ends 58 are forced into juxtaposition and generally parallel to one another in the center of slot 55 as shown in FIG. 5A. The alignment pins 60*a*, 60*b* of the invention will generally only allow the overlapped wire ends 58 to be in the position shown in FIGS. 4A and 5A. Also, the alignment pins keep the wires next to each other with little spacing therebetween.

To further secure the overlapped wire ends 58 within slot 55 in the appropriate pinions and gears, one embodiment of the present invention utilizes the spring-loaded locking structures 36 as illustrated in FIGS. 1, 4, and 4A. The locking structures 36 rotate within a cylindrical channel formed in cover 34 (see FIG. 1), and a finger portion 66 of the locking structures is engaged by the spring 67 held within an appropriately formed opening in the cover 34 by a set screw 69. The force of the spring acts on finger portion 66 and rotates the locking structure 36 such that the finger portion 66 moves in front of the portion of the slot 55 which is formed by the slotted opening in the cover 34. Referring to FIG. 4A, rotation of the locking structure 36 essentially closes a portion of slot 55 proximate cover 34 and proximate the alignment pins 60*a*, 60*b*. Locking structure 36 provides an additional structure for maintaining the overlapped wire ends 58 within the slot 55. Of course, the mechanism 10 of the present invention may be utilized without locking structure 36 relying only upon the alignment pins 60*a*, 60*b* for maintaining the overlapped wire ends 58 within slot 50.

When the twister gears 18*a*, 18*b* are rotated by the turning of the drive gear 40, the pinions 20*a*, 20*b* are coupled to the respective twister gears and rotate therewith. To that end, each of the twister pinions has an indent or alignment groove 70 formed therein which aligns with an opening or alignment aperture 72 formed in the respective twister gear. When the twister gear end pinions are positioned together so that the slot portions of each piece are aligned to form slot 55, a pin 73 is directed through the alignment aperture 72 to rest within the alignment groove 70 as illustrated in FIG. 4A. The pinions and gears are then firmly coupled together. In that way, rotation of twister gear 18*a*, 18*b* will produce rotation of the respective pinion 20*a*, 20*b*.

As mentioned above, one embodiment of the present invention utilizes a 2:1 drive gear to twister gear ratio so that a single revolution of the drive gear 40 rotates each of the twister gears 18*a*, 18*b* twice. To provide for proper alignment of the slotted portion of each of the twisting components to form the appropriate slot 55 to receive the overlapped wire ends 58, the invention further comprises spring-loaded alignment pins 80 which extend through appropriate openings 81 formed in the upper housing section 12*a* and lower housing section 12*b* (see FIG. 2) . The appropriate openings 81 in housing 12 align with an opening 83 formed in bearing 46. The hub portion 44 of drive gear 40 includes opposing indents 84 which are engaged by the pins 80. Each pin 80 is biased by an appropriate spring structure 86 and set screw 87 for directing the pins into the indents 84. When both of the pins 80 are in the indents 84, each twister gear and respective pinion is aligned with the other twister gear and respective pinion so that the overlapped wire ends 58 may be engaged by mechanism 10 for tying a bale. Therefore, the invention saves time and increases the overall efficiency of the tying procedure by providing proper and rapid alignment of the slot portions to form a single slot 55 without an operator rotating the handle back and forth to find the proper alignment. Once the slot 55 is formed, and the wires engaged, the handle 52 may be turned to rotate the pinions and twister gears. As illustrated in FIG. 1, appropriate cut-outs 88 are formed so that the teeth of portion 25 of the twister gear may engage the teeth of portion 42 of the drive gear 40.

To prevent binding of the wire ends 58 when they are twisted or rotated to form a knot, each of the inside ends of the pinions 20*a*, 20*b* has conical indent 71 (see FIG. 1). Conical indent 71 prevents the twisted portions of the wires from binding at the point where the inner ends of the pinions come together between the legs 16*a*, 16*b*.

Figure 3:
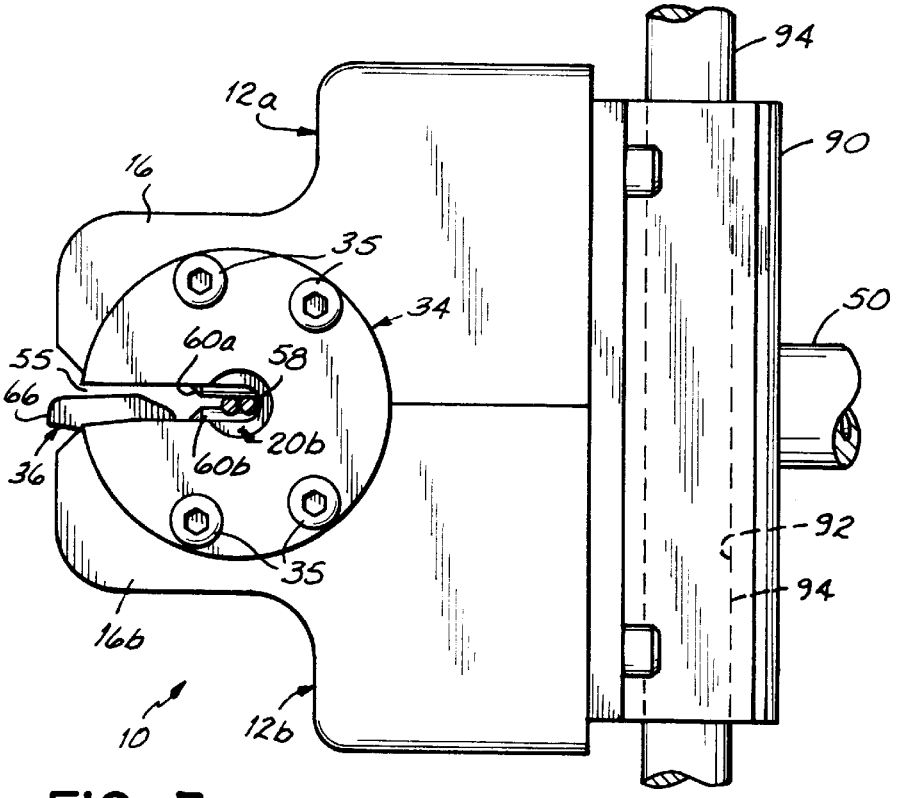
FIG. 3 is a side view of the embodiment of the invention illustrated in FIG. 1.

To further increase the efficiency of the tying operation, another embodiment of the invention, as illustrated in FIG. 3, might utilize a pair of bearing blocks 90 attached to housing 12. Bearing blocks 90 form cylindrical bearing openings 92 therein which allow the bearing blocks to slide on an elongated guide bar 94. FIG. 3 illustrates one bearing block which is preferably positioned on one side of handle shaft 50. In a preferred embodiment, another bearing block is utilized on the other side of the handle shaft 50 for providing further guidance of the twister. With the embodiment illustrated in FIG. 3, a single twister may be moved across a bale to tie each and every wire wrapped around a bale along its length or width. In that way, a single tying mechanism 10 may be utilized to tie an entire bale.

In accordance with another aspect of the present invention, mechanism 10 may be quickly and easily retrofitted for handling various different gauges of wire. In that way, the invention eliminates the necessity of having to have specially formed mechanisms for different gauges of wire and thus reduces the cost of the overall baling and tying process. To that end, the pinions may be rapidly removed by disassembling housing 12 to remove the pinions and twister gears and then tapping out the respective pins 73 from the pinions and gears. A new, smaller-dimensioned pinion may then be slid into the same gear 18*a* or 18*b* and the pin 73 replaced to present a tying mechanism which will tie a different gauge of wire. In accordance with the principles of the present invention, the alignment pins 60*a*, 60*b* will be appropriately formed and spaced in the slot 55 for engaging the particular gauge of wire utilized.

Figure 6:
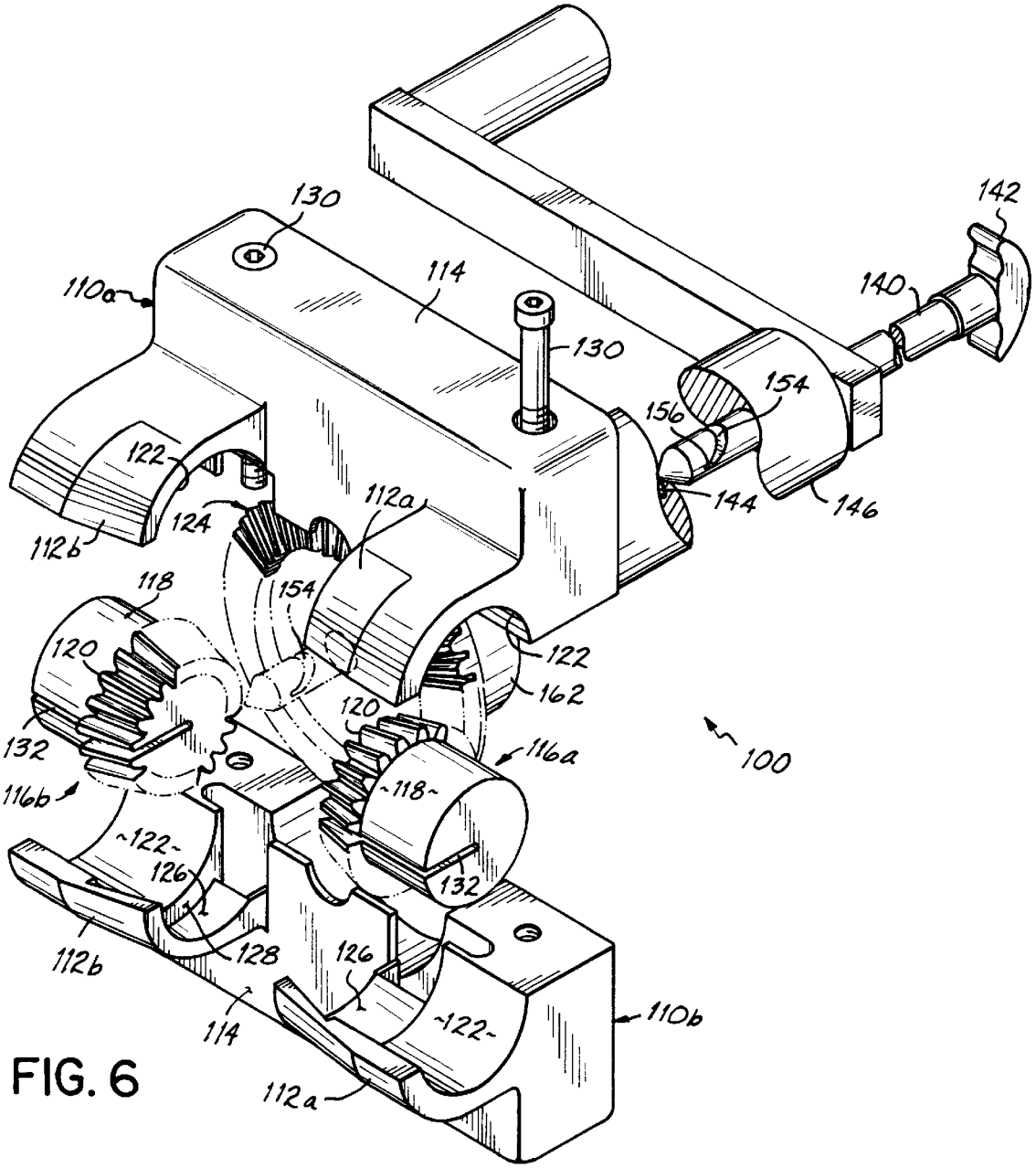
FIG. 6 is a disassembled perspective view of another embodiment of the bale tying apparatus of the invention.

An alternative embodiment of the invention is disclosed in FIG. 6, wherein the mechanism 100 includes a yoke-shaped housing 110, having upper and lower sections 110*a* and 110*b*, respectively. Yoke-shaped housing 110 includes legs 112*a*, 112*b* and a crossbar portion 114. Twister pinions 116*a*, 116*b* each have a hub portion 118 and a gear portion 120. The twister pinions 116*a*, 116*b* are each positioned in appropriately formed openings in each of the legs 112*a*, 112*b* so that the pinions oppose each other on either side of the housing 110. The twister pinions each have an appropriately formed slot therein for receiving overlapped wire ends.

Gear portions 120 of the twister pinions 116*a*, 116*b* are beveled for engaging a beveled drive gear 124. The legs 112*a*, 112*b* of housing 110 each include an appropriately formed sloped portion 126 which acts to secure the twister pinions in the housing and to prevent their movement toward each other when the wire ends are twisted to form a knot. The gear portions 120 of each twister pinion are larger in effective diameter than the hub portion 122, and a shoulder 128 adjacent the sloped portion 126 of each leg engages the larger gear portions 120 to prevent their axial movement away from each other and out of the housing. In that way, the twister pinions are secured within housing 110 when the two sections 110*a* and 110*b* are secured together, such as with appropriate bolts 130.

Figure 7:
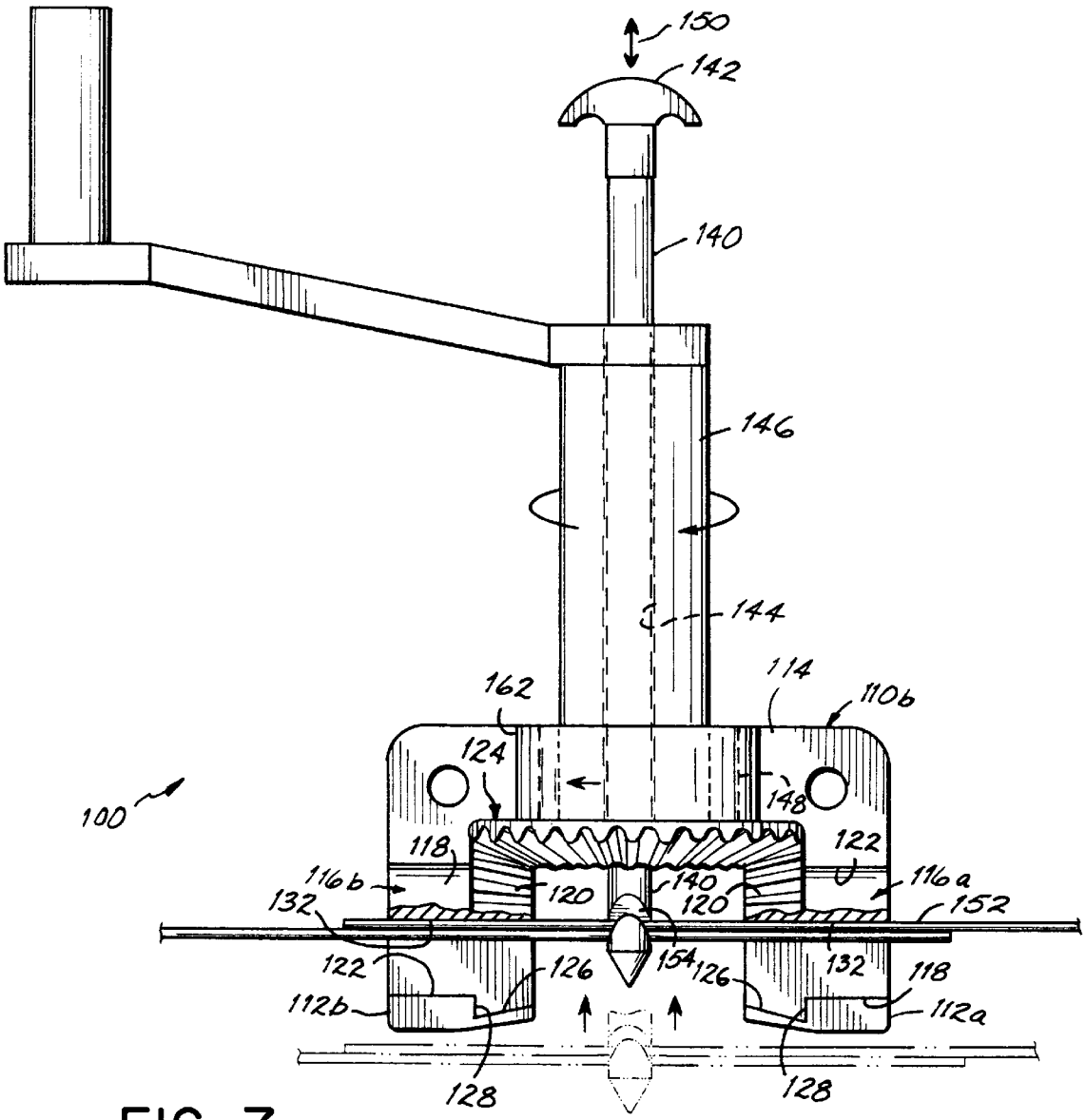
FIG. 7 is a top view of the embodiment illustrated in FIG. 6.
Figure 8:
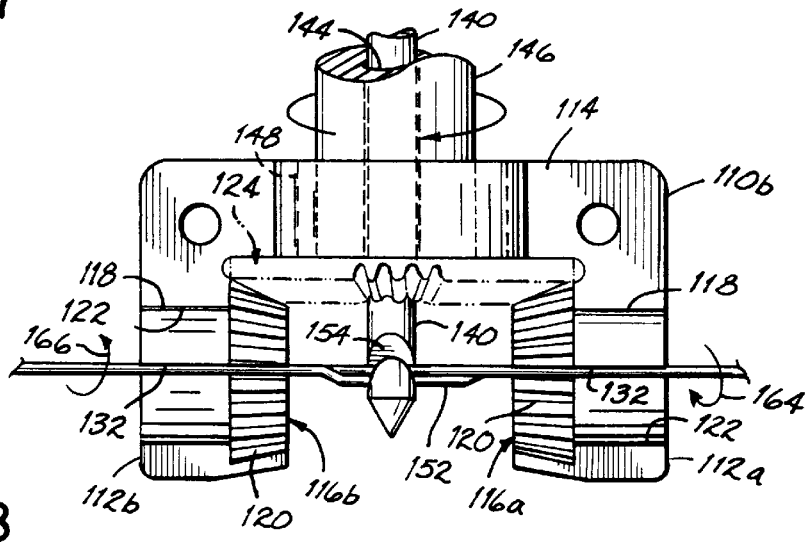
FIG. 8 is a top view of a portion of the embodiment illustrated in FIG. 6.

In accordance with one principle of the present invention, mechanism 100 includes a moveable retrieving device for engaging the ends of the binding wire and moving the ends into the twister pinion slots 132 for twisting the ends and tying them together to bind a bale. One preferred embodiment of the retrieving device is illustrated in FIGS. 6–8, and is in the form of an elongated shaft which is movable in a direction generally parallel to the rotational axes of the twister pinions. Referring to FIG. 7, shaft 140 is connected at one end to a movable handle 142 and slides within a cylindrical bearing opening 144 which is formed in the crank shaft 146 coupled with the hub portion 148 of drive gear 124. Shaft 140 extends through the crank shaft 146 and may be moved forwardly and backwardly as indicated by reference arrow 150 in FIG. 7 to move the overlapped wire ends 152 into the slots 132 of the twister pinions 116*a*, 116*b*. Retrieving shaft 140 has an angled slot 154 formed in the end thereof proximate the twister pinions. The slot is dimensioned to accommodate the gauge of the overlapped wire ends 152 so that the overlapped wire ends will slide into the slot. Referring to FIG. 6, slot 154 includes a flattened, horizontal portion 156 which extends in the direction of movement of shaft 140, at an angle to the angled slot 154. In that way, the overlapped wire ends held in slot 154 are held in the proper horizontal position for engaging the slots 132 of the twister pinions.

Referring to FIG. 7, handle 142 is used to move the slotted portion of shaft 140 forward to engage the overlapped wire ends as shown in phantom. The mechanism 100 is manipulated until the wire ends are in slot 154. Next, the handle is pulled toward the twister pinions for introducing the overlapped wire ends 152 into the pinion slots 122. Crankshaft 146 is connected to a handle 160 for rotating the crankshaft. As illustrated in FIG. 8, one end of the crankshaft 146 is pressure or friction fit into the hub portion 148 which is surrounded by an appropriately formed bearing 162 which allows the hub portion 148 to rotate within the housing 110. Shaft 140 slides back and forth within crankshaft 146. Referring to FIG. 8, once the wires have been engaged by slot 154 of shaft 140, they are pulled toward the mechanism so that the overlapped ends 152 fit into the slots of the pinions. Handle 160 is then turned to rotate the drive gear 124 and rotate the twister pinions 116*a*, 116*b*. As with the embodiment previously described, mechanism 100 has twister pinions which are positioned on diametrically opposite sides of the drive gear. Therefore, rotating the drive gear will rotate the twister pinions 116*a*, 116*b* in opposite directions. That is, one will rotate clockwise 164 and the other will rotate counter-clockwise 166 to twist a knot into the overlapped wire ends 152 and secure the ends together to bind a bale.

After the wire ends 152 have been tied or knotted, the handle 160 is used to push the shaft 140 forward again to remove the twisted ends 152 from the twister pinions and thus disengage the mechanism 100 from the bale.

FIGS. 9–12 disclose alternative pinion and gear structures and locking structures for another embodiment of the invention. Specifically, the pinion 180 of the alternative embodiment includes a relief area 182 formed in the slot 183 of the pinion. The relief area 182 of the pinion provides a widening of a portion of the slot and allows for movement of the twisted portions of the wire after they have been twisted so that the wires may be removed from slot 183. In that way, binding of the twisted wires proximate to the alignment pins 184 is prevented. As previously discussed, and as illustrated in FIGS. 4 and 5, the pairs of wires, which are positioned in pinion 180 for being twisted, would tend to kink proximate the alignment pins 184, due to the vertical spacing of the pins and also their staggered position along the length of pinion 180. The relief area 182 prevents binding of the twisted wires against the pinion walls forming slot 183 and against the alignment pins 184.

Figure 9:
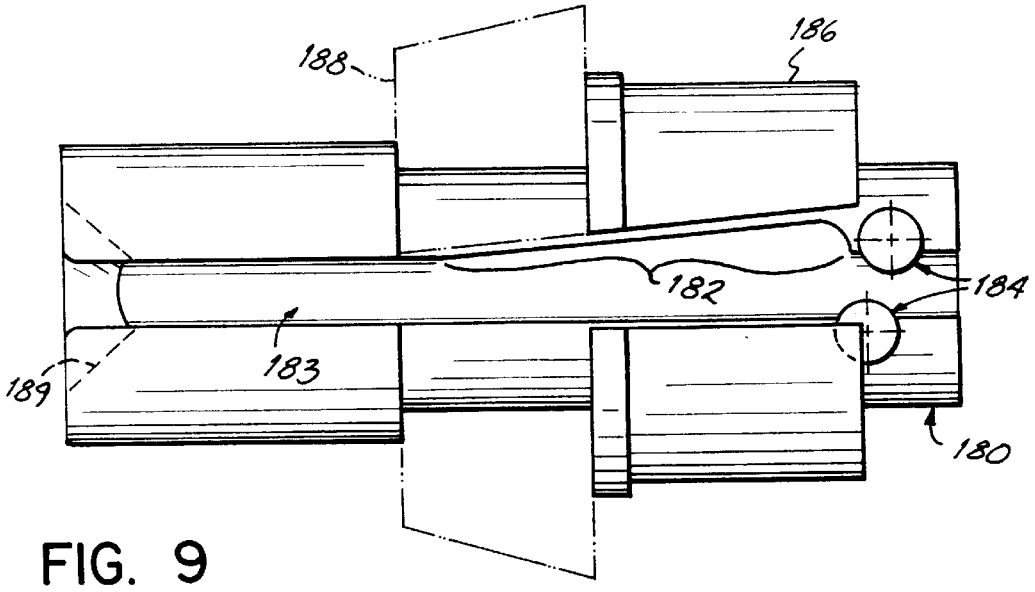
FIG. 9 is a front view of another embodiment of a twister pinion for use in the present invention.

In the embodiment illustrated in FIG. 9, the relief area 182 extends along a substantial portion of the pinion 180 proximate pins 184. Alternatively, the relief area 182 may extend along the entire length of pinion 180. The sleeve bearing, 186 and twister gear 188 are also preferably relieved where they overlap relief area 182 of pinion slot 183 to provide for easy engagement of wires to be twisted and subsequent disengagement after they have been twisted. As discussed hereinabove, pinion 180 also includes a conical indent or countersink 189 to prevent binding or trapping of the wires at the point where the pinions come together in the mechanism. Preferably, one of the alignment pins 184 includes a plunger, as illustrated in FIG. 12 and discussed further hereinbelow for locking the wires into the pinion while they are twisted.

Figure 10:
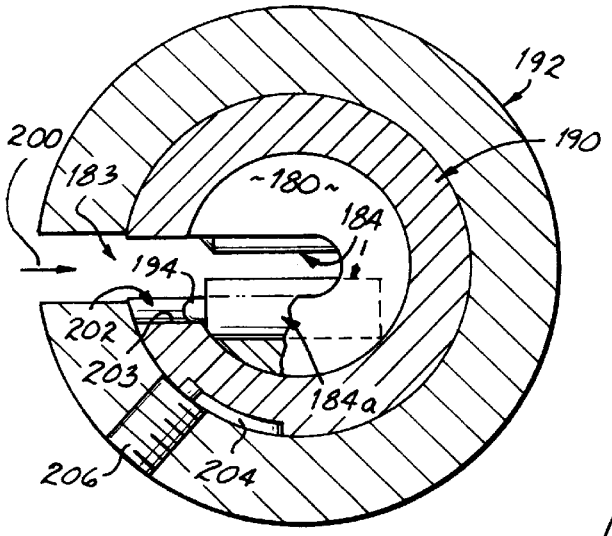
FIG. 10 is a side view and partial cross-section, of a locking structure for use with the present invention.
Figure 11:
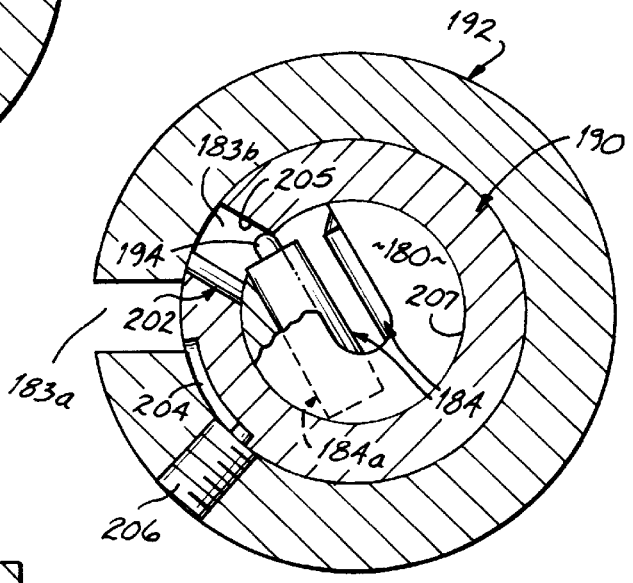
FIG. 11 is a side cross-sectional view, similar to FIG. 10 of the locking structure.
Figure 12:
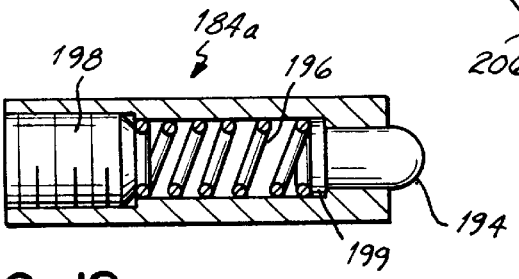
FIG. 12 is a side cross-sectional view of a locking pin of the present invention.

Referring to FIGS. 10, 11, and 12, locking structure 190 is concentrically fit into a cover 192 similar to cover 34 in the embodiment illustrated in FIG. 1. Locking structure 190 rotates within cover 192 as illustrated in FIG. 11. More specifically, pinion 180 includes an alignment pin 184*a* which has a spring-loaded plunger 194 therein. Referring to FIG. 12, the spring-loaded plunger 194 is biased by a spring 196 in the pin 184*a*. Spring 196 is held at the end opposite the plunger by a set screw 198. A shoulder 199 on the plunger 194 couples to a corresponding shoulder in the body of the pin 184*a*, as illustrated, to prevent the plunger from being pushed all of the way out of pin 184*a*.

As illustrated in FIG. 10, when the pinion 180, locking structure 190 and cover 192 are aligned, wires may be placed in the pinion by moving them into slot 183, as illustrated by the reference arrow 200. Generally, the slots of the individual elements will be aligned to collectively form slot 183 when the alignment pins are in the respective indents, as discussed hereinabove.

Locking structure 190 includes a radial slot 202 for receiving the plunger 194 when all the elements are aligned, as illustrated in FIG. 10. Locking structure 190 also includes a peripheral slot 204 which engages the end of a set screw 206 threaded into an appropriate opening in cover 192 for limiting the rotational movement of the locking structure 190 as discussed further hereinbelow. When the mechanism is aligned to provide slot 183 for receiving the wires, plunger 194 rests within radial slot 202 and generally hinders counter-clockwise rotation of pinion 180 with respect to the locking structure 190. When pinion 180 is rotated counter-clockwise, the plunger 194 will engage slot 202, generally perpendicular to the side 203 of the slot 202. Because of the generally perpendicular engagement of the side of the plunger 194 with side 203, when the pinion 180 is rotated counter-clockwise, the locking structure 190 will also try to rotate counter-clockwise. The end of set screw 206 engaging slot 204 will allow some counter-clockwise rotation of the locking structure 190 with pinion 180. However, it will stop such rotation when the end of pin 206 reaches the end of slot 204. The pinion 180 and locking structure will then generally not be able to rotate any further in the counter-clockwise direction. It will be understood that pinion 180 might be forced and that the plunger might be made to retract to allow counter-clockwise pinion rotation. However, for the general purposes of the invention, such rotation is stopped. The limited movement of locking structure 190 provides a locking of the wires to be twisted within slot 183 when pinion 180 is rotated clockwise as shown in FIG. 11.

Referring to FIG. 11, when pinion 180 is rotated clockwise, pins 184 and plunger 194 will rotate therewith and will move to engage the other side 205 of the portion of slot 183 formed by the locking structure 190. When plunger 194 engages side 205, it will rotate the locking structure 190 as shown, in a clockwise direction, to separate the slot portion 183*a* formed by cover 192 from slot portion 183*b* formed by locking structure 190. In that way, the slot portions 183*a* and 183*b* are misaligned and the wires to be twisted are prevented from moving out of the pinion 180. Plunger 194 will act on locking structure 190 until it rotates the locking structure such that the end of set screw 206 engages the other side of slot 204. In that way, the clockwise rotation of locking structure 190 will be stopped. Because of the angle at which the plunger 194 engages side 205 of the locking structure, the plunger will be retracted or pushed inwardly against the spring 196 so that the alignment pin 184 allows rotation of pinion 180 in a clockwise direction with respect to the locking structure 190.

The spring 196 acts on plunger 194 during rotation and pushes it against an inner diameter surface 207 of the locking structure 190 during rotation. The friction between plunger 194 and surface 207 keeps the locking structure locked. In that way, the locking structure is maintained in the locked position as shown in FIG. 11 as the pinion rotates in a clockwise direction. As pinion 180 rotates, the plunger will again engage the slotted portion 183*b* and will extend and subsequently retract to allow for continued rotation of the pinion. After the twisting of the wires is complete, pinion 180 is rotated past slot portion 183*a* to engage slot portion 183*b*. Then, the pinion 180 is rotated counter-clockwise so that plunger 194 again engages slot 202 as illustrated in FIG. 10. Since plunger 194 does not generally retract in that position, the locking structure 190 will be carried in a counter-clockwise direction until slot portion 183*b* again lines up with slot portion 183*a*. Such alignment will generally correspond with set screw 206 hitting the end of slot 204. In that way, the twister wires are unlocked and may be removed from the mechanism. Preferably, slot 204 is formed so that the locking structure may rotate sufficiently to provide locking as illustrated in FIG. 11, and then unlocking, as illustrated in FIG. 10 with an aligned slot 183. The clockwise and counter-clockwise arrangements are relative, and the pinion and locking mechanisms might be set up to lock counter-clockwise and unlock clockwise.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A mechanism for securing together the overlapped ends of an elongated binding device wrapped around a bale of compressible material for binding the bale, the mechanism comprising:

a housing;

a twister pinion rotatably coupled to the housing and configured to receive overlapped ends of an elongated binding device into a slot therein, the twister pinion including a pair of alignment pins extending into the slot from opposing sides of the slot and staggered longitudinally in the slot, the alignment pins operable for engaging the overlapped ends and maintaining said ends in the pinion slot and in an overlapped orientation;

a drive mechanism operably coupled to the pinion for rotating the pinion and twisting the overlapped ends.

2. The mechanism of claim 1 wherein the alignment structure comprises at least one pin extending into the slot for engaging the overlapped ends.

3. The mechanism of claim 1 wherein the alignment structure comprises a pair of pins extending into the slot for engaging the overlapped ends.

4. The mechanism of claim 3 wherein the pins are positioned on generally opposing sides of the slots for engaging the overlapped ends.

5. The mechanism of claim 1 further comprising a cap structure coupled to an end of the pinion, the cap structure operable for closing an end portion of said slot when the overlapped ends are positioned therein for securing the ends in the slot.

6. The mechanism of claim 1 wherein the drive mechanism includes a twister gear coupled to the pinion for turning the pinion.

7. The mechanism of claim 6 wherein the drive mechanism further comprises a drive gear coupled to said twister gear for turning the twister gear and pinion.

8. The mechanism of claim 7 wherein said drive mechanism includes a rotatable handle for rotating said drive gear.

9. The mechanism of claim 1 further comprising a pair of opposing twister pinions, said drive mechanism operably coupled to said pinions for rotating the pinions in opposite directions.

10. The mechanism of claim 1 further comprising a bearing block coupled to said housing, the bearing block configured for engaging a guide structure to guide the mechanism when binding a bale.

11. The mechanism of claim 1, wherein said twister pinion slot includes a relief area for effectively widening the slot to prevent binding of the overlapped ends.

12. The mechanism of claim 1 further comprising a locking structure coupled to an end of the pinion, the locking structure partially rotatable with the pinion and operable for blocking a portion of said pinion slot for containing the overlapped ends.

13. The mechanism of claim 12 wherein said alignment structure includes a movable plunger for engaging said locking structure, the plunger extending when the pinion is rotated in one direction for rotating the locking and retracting when the pinion is rotated in the other direction.

14. The mechanism of claim 12 further comprising a limit structure for limiting the rotation of said locking structure.

15. A mechanism for securing together the overlapped ends of an elongated binding device wrapped around a bale of compressible material for binding the bale, the mechanism comprising:

a housing;

a first twister pinion rotatably coupled to the housing and configured to receive overlapped ends of an elongated binding device into a slot therein, the pinion including a twister gear portion;

a rotatable drive gear operably engaged with the twister gear portion of the pinion for rotating said twister pinion and twisting the overlapped ends of the elongated binding device to tie the ends together;

a retrieving device movably coupled with the body for moving toward and away from the twister pinion, the retrieving device configured for engaging the overlapped ends of the binder device and moving said ends into said twister pinion slot to tie said ends together.

16. The mechanism as in claim 15 further comprising a second twister pinion rotatably coupled with the housing for rotating with the first twister pinion and having a twister gear portion and a slot therein generally aligned with said first pinion slot for receiving said overlapped ends.

17. The mechanism of claim 16 wherein said retrieving device is positioned to move between said first and second twister pinions to move the overlapped ends into the aligned slots.

18. The mechanism of claim 16 wherein said rotatable drive gear is operable for driving the first pinion in one direction and driving the second pinion in an opposite direction to twist said overlapped ends.

19. The mechanism of claim 15 wherein said retrieving device comprises an elongated element having a slot formed therein for receiving said overlapped ends to be twisted.

20. The mechanism of claim 15 wherein said drive gear is coupled to a manually operated handle for manually rotating the drive gear.

21. The mechanism of claim 15 wherein said retrieving device is coupled to a manually operated handle for manually moving the overlapped ends to the twister pinion.

* * * * *